US011795753B1

(12) United States Patent
Ikeler et al.

(10) Patent No.: US 11,795,753 B1
(45) Date of Patent: Oct. 24, 2023

(54) REMOTE MONITORING AND CONTROL OF GARAGE DOOR OPENER INCORPORATING JACKSHAFT DOOR OPERATOR DRIVE ASSEMBLY

(71) Applicant: GMI Holdings, Inc., Mount Hope, OH (US)

(72) Inventors: Tim Ikeler, Alliance, OH (US); LeRoy G. Krupke, Carrollton, TX (US); Brent Buescher, Wooster, OH (US); Brent Alan Rauscher, Keller, TX (US); Michael Dragomier, North Canton, OH (US)

(73) Assignee: GMI Holdings, Inc., Mount Hope, OH (US)

( * ) Notice: Subject to any disclaimer, the term of this patent is extended or adjusted under 35 U.S.C. 154(b) by 567 days.

(21) Appl. No.: 16/395,075

(22) Filed: Apr. 25, 2019

Related U.S. Application Data

(60) Provisional application No. 62/662,701, filed on Apr. 25, 2018.

(51) Int. Cl.

| | |
|---|---|
| ***H04H 20/71*** | (2008.01) |
| ***G07C 9/00*** | (2020.01) |
| ***E05F 15/77*** | (2015.01) |
| ***G08C 17/00*** | (2006.01) |
| ***E05F 15/60*** | (2015.01) |
| ***E05F 15/79*** | (2015.01) |
| *G08B 5/36* | (2006.01) |

(52) U.S. Cl.
CPC ..... *E05F 15/77* (2015.01); *E05F 15/60* (2015.01); *E05F 15/79* (2015.01); *G08C 17/00* (2013.01); *E05Y 2900/106* (2013.01); *G08B 5/36* (2013.01)

(58) Field of Classification Search
CPC ... E05F 15/77; E05F 15/79; E05F 15/60; G08C 17/00; G08B 5/36; E05Y 2900/106
See application file for complete search history.

(56) References Cited

U.S. PATENT DOCUMENTS

| | | | | |
|---|---|---|---|---|
| 6,346,889 | B1 * | 2/2002 | Moss | G08B 13/08 340/545.1 |
| 7,468,676 | B2 * | 12/2008 | Styers et al. | G08B 13/19656 340/686.1 |
| 8,421,591 | B2 * | 4/2013 | Karasek | G07C 9/00182 340/5.71 |
| 8,587,404 | B2 * | 11/2013 | Laird | E05F 15/684 340/5.7 |
| 9,122,254 | B2 * | 9/2015 | Cate et al. | G05B 15/00 |

(Continued)

*Primary Examiner* — Hai Phan
*Assistant Examiner* — Son M Tang
(74) *Attorney, Agent, or Firm* — HAYNES AND BOONE, LLP

(57) ABSTRACT

A garage door status monitoring and control system includes a control module for receiving door position information and receiving change of door position commands from a remote Internet access device. The control module includes a programmable platform configured to: route door position information to a wireless interface for transmission to the Internet access device; and cause said change of door position commands to generate a light and sound command and a door position command. A Bluetooth microprocessor generates a wireless signal to actuate a light fixture in response to the light and sound command. The light fixture includes a microprocessor for wirelessly returning an acknowledge signal. The acknowledge signal is conductively transmitted to the programmable platform from the Bluetooth microprocessor. Receipt of the acknowledge signal allows the door position command to be generated only after a defined period of time following the generation of the light and sound command.

8 Claims, 1 Drawing Sheet

(56) References Cited

U.S. PATENT DOCUMENTS

| | | | | |
|---|---|---|---|---|
| 9,734,645 | B2* | 8/2017 | Farber et al. | G07C 9/28 |
| 10,540,889 | B2* | 1/2020 | Ikeler et al. | E05F 15/77 |
| 10,733,823 | B2* | 8/2020 | Scalisi | G07C 9/00309 |
| 2003/0029579 | A1* | 2/2003 | Mays | G07C 9/00309 160/188 |
| 2003/0102836 | A1* | 6/2003 | McCall | E05F 15/668 318/445 |
| 2005/0012631 | A1* | 1/2005 | Gregori et al. | G08B 25/085 340/686.1 |
| 2005/0184854 | A1* | 8/2005 | Mullet et al. | G07C 9/00182 340/5.22 |
| 2005/0237014 | A1* | 10/2005 | Murray | E05F 15/668 318/280 |
| 2007/0000622 | A1* | 1/2007 | Reed et al. | E05F 15/40 160/188 |
| 2007/0185597 | A1* | 8/2007 | Bejean et al. | H04L 12/282 700/83 |
| 2010/0127882 | A1* | 5/2010 | Sitarski | E05F 15/77 340/686.1 |
| 2010/0242369 | A1* | 9/2010 | Laird | E05F 15/684 49/358 |
| 2015/0275564 | A1* | 10/2015 | Rosenthal et al. | E05F 15/668 700/275 |
| 2016/0300415 | A1* | 10/2016 | Deneen et al. | G07C 9/00571 |
| 2018/0160273 | A1* | 6/2018 | Huggins et al. | H04L 67/18 |

* cited by examiner

REMOTE MONITORING AND CONTROL OF GARAGE DOOR OPENER INCORPORATING JACKSHAFT DOOR OPERATOR DRIVE ASSEMBLY

CROSS REFERENCE TO RELATED APPLICATION

This application claims the benefit of U.S. Provisional Application No. 62/662,701 titled "REMOTE MONITORING AND CONTROL OF MOVABLE BARRIER STATUS IN SYSTEM INCORPORATING RESIDENTIAL JACKSHAFT DOOR OPERATOR", filed Apr. 25, 2018, which is hereby incorporated by reference in its entirety for all purposes.

TECHNICAL FIELD

The present disclosure relates to the field of remote network monitoring and control of movable barrier apparatus, more particularly to the remote monitoring and control, via the Internet, of garage door openers, and even more particularly to the remote monitoring and control, via the Internet, of garage door openers that incorporate a jackshaft door operator drive assembly.

BACKGROUND

Movable barriers, such as upward-acting sectional or single panel garage doors, residential and commercial rollup doors, and slidable and swingable gates, are used to alternatively allow and restrict entry to building structures and property. These barriers are typically driven between their respective open and closed positions by movable barrier openers, which in the specific case of a garage door, are "garage door openers", which respectively include motors and associated motor drive assemblies, which are themselves controlled by "garage door operators." Garage door operators are effective to cause the motor, and the associated motor drive assembly, to move the connected garage door, typically between its fully open and closed positions.

Each garage door operator includes a door controller (typically, a microprocessor, microcontroller, programmable logic or gate array or other programmable platform) for processing incoming door commands and generating output control signals to the motor which, in combination with its associated motor drive assembly, moves the garage door in accordance with the incoming door commands. The incoming door commands, in the past, have been in the form of wired or wireless signals transmitted from interior or exterior wall consoles, or from proximately located hand held or vehicle mounted RF transmitters.

However, with the near ubiquity of the Internet and the proliferation of electronic devices and equipment designed to access the Internet, such as personal computers, cellphones, and Smartphones, garage door opener systems are currently being designed and implemented in the trade that enable non-proximate, or remote, monitoring and control, via the Internet, of door status. For example, if a homeowner is not in proximity to its residence, and wants to determine whether the garage door the homeowner had intended to close, did in fact close, or whether the garage door it intended to leave open for a workman to enter, had in fact been left open, using one of these systems, the homeowner can, through access to the Internet, remotely monitor the status of the garage door (e.g., whether it is open or closed). Moreover, if the garage door is not in the desired position, these systems are designed to also enable the homeowner to transmit change-of-door status commands over the Internet to cause the garage door opener to move the garage door to the desired position, all without having to be physically proximate the garage to do so.

Particular challenges have been encountered when the motor drive assembly is of the type known in the industry as a jackshaft drive assembly. As conventionally known, a jackshaft drive assembly is one in which, typically, the motor is directly coupled to a horizontally positioned shaft (i.e., the jackshaft) extending along the width of, and mounted above, the movable barrier, one or more cable drum(s) rigidly attached to the jackshaft. One or more cables are wound about the cable drum(s) with the free end of each cable connected to, and at the lower end of, the movable barrier. When the motor is actuated to open the door, the jack shaft and the cable drum(s) are consequently rotated in a direction so as to wind the cable(s) on to the cable drum(s), thereby lifting the movable barrier to its open position. When the motor is actuated to close the door, the jackshaft and the cable drum(s) are consequently rotated in an opposite direction so that the cable(s) may be payed out, thereby permitting the movable barrier to be closed by the combination of the restoring force provided by a torsion spring wound around the jackshaft and the unsupported portion of the weight of the movable barrier.

One of the requirements that must be met in connection with a remotely generated door command is to actuate a flashing light and sound warning sufficiently in advance of the impending unattended door movement to warn anyone who may be in the path of the door travel. However, due to the inherent design of the jackshaft drive assembly, the warning light and sounder must be separately mounted from the drive assembly while at the same time being in effective bi-directional communication with the garage door opener. In addition, accurate monitoring of the position of the door requires that an appropriate sensor be provided that effectively and accurately interconnect the jackshaft drive assembly with the monitoring portion of the system.

SUMMARY

In accordance with the aforementioned and other objectives, disclosed herein is remote monitoring and control apparatus comprising a jackshaft type garage door opener in combination with an integrated door control module (iDCM), the iDCM enabling the user to (i) monitor and remotely transmit, via the Internet, the positional door status (e.g., the "open"/closed" status) of the user's garage door, and (ii) receive and process change-of-positional door status commands remotely transmitted, via the Internet, to activate the garage door opener to move the garage door to the position instructed by the change-of-positional door status commands.

In accordance with a unique feature of the herein described monitoring and control apparatus, an absolute position encoder (APE) is operatively coupled with the motor driven rotating jackshaft to generate an output signal corresponding to the extent and direction of such rotational movement, and therefore corresponding to the extent and direction of movement of the garage door. These positional signals are then routed to the iDCM, specifically a first microprocessor of the iDCM, which microprocessor has been preprogrammed to sequentially (i) determine, from multiple open/close cycles of the garage door, the location of the fully closed travel limit of the garage door, (ii) then, when garage door movement thereafter ceases, determine whether the garage door is sufficiently close to such lower travel limit to be deemed "closed", or if not sufficiently close to the lower travel limit, to be deemed "not closed" (i.e., "open"), and (iii) finally, generate digital door status output signals corresponding to either the "closed" or "open" status of the garage door. These digital door status signals are subsequently routed for wireless transmission of the "open" or "closed" positional door status to the desired remote location.

In accordance with another unique feature of the monitoring and control system, the jackshaft door opener is in bidirectional wireless communication with a work light and sounder assembly. This communication is established by way of a short-range wireless interconnection assembly, preferably using the Bluetooth standard, comprising a host module and a fixture in which the work light and sounder are mounted. The host module is configured and programmed to transmit wireless instructions to the fixture to activate the work light and/or the sounder in a manner depending upon whether the incoming positional door status command is remotely or proximately generated. Remotely generated door commands result in instructions to flash the work light and activate the warning sound for a pre-determined time period in advance of the impending unattended garage door movement. Proximately user-generated door commands result in instructions to the fixture to merely turn the work light on (or off). The garage light/sounder fixture is configured and programmed to wirelessly transmit an acknowledge signal to the host module confirming receipt of the wireless instructions from the host module. The absence of this acknowledge signal during the processing of the remotely generated door status command preventing the unattended garage door movement.

BRIEF DESCRIPTION OF THE DRAWINGS

Additional features of the herein described method and apparatus will become readily understood from the following detailed written description, taken in conjunction with the appended drawing, in which the sole figure.

DETAILED DESCRIPTION

Figure 1:
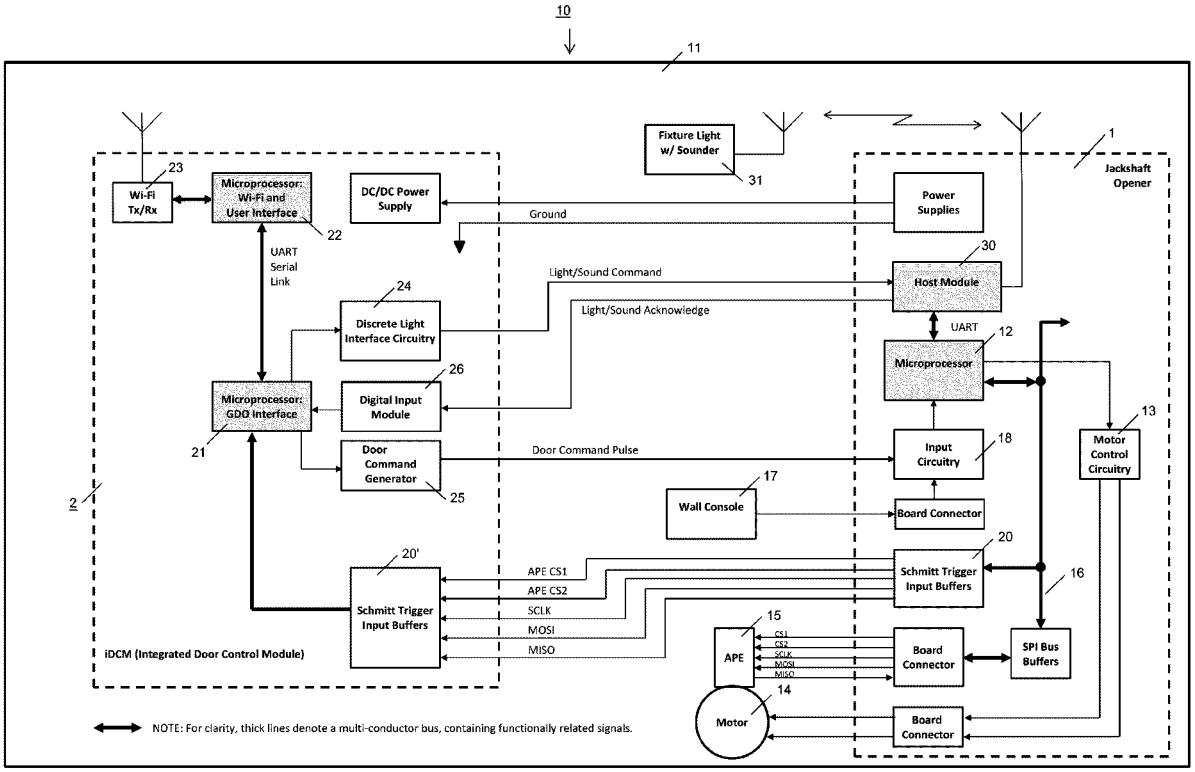
FIG. 1, is a block diagram schematic of the remote monitoring and control apparatus in accordance with the principles of the present invention.

An embodiment of the remote movable barrier status monitoring and control system in accordance with the principles of the present invention will be described below. This described embodiment is only a non-limiting example of implementation of the invention as defined solely by the attached claims.

With initial reference now to FIG. 1, there is depicted a detailed block diagram schematic of a preferred embodiment of the garage door monitoring and control system 10 of the present invention located within power head chassis 11. The system 10 comprises (i) the jackshaft garage door opener 1 (material components of which are principally located within the dotted lines at the right side of the block diagram schematic) and (ii) the integrated door control module 2 (material components of which are principally located within the dotted lines at the left side of the block diagram schematic).

The jackshaft garage door opener 1 is configured to control the movement of the associated garage door (not shown) in accordance with both remotely generated and proximately generated positional door status commands. Material components of the garage door opener 1 include garage door operator controller 12, motor control circuitry 13, and DC motor 14. The garage door operator controller 12 preferably comprises a programmable microprocessor for processing incoming positional door status commands, both remotely generated and proximately generated, and, in response, generating output control signals to the motor 14, via the motor control circuitry 13, to move the garage door in accordance with the incoming commands.

The integrated door control module 2 is configured to (i) monitor the status of the garage door, specifically whether it is "open" or "closed", and wirelessly transmit such status to the desired remote location, as well as (ii) processing received remotely generated change-of-positional door status commands to actuate the jackshaft opener 1 to move the garage door in accordance with such commands after activating a warning, in the manner subsequently described, of the impending unattended garage door movement.

Proximately generated positional door status commands, for example as a result of user-activation of wall console 17, are inputted to controller 12 via input circuitry 18. As subsequently described, the remotely generated door command pulse is also inputted to controller 12 via input circuitry 18.

In accordance with a unique feature hereof, a short range wireless communication assembly, comprising a host module 30 and fixture 31, in bidirectional wireless communication with one another, is an integral part of the overall system 10. While various wireless standards may be employed to effect this wireless communication, the Bluetooth® standard is preferred for this embodiment. Fixture 31, incorporating a programmable microprocessor and wireless transceiver, and so constructed to retain an electrically actuable work light and warning sounder, is adapted to actuate the work light 1 and warning sounder in response to, and in accordance with the nature and content of, an incoming wireless instruction signal transmitted from host module 30. In response to the receipt by the fixture 31 of such incoming wireless instruction signal, an acknowledge signal is wirelessly transmitted from the fixture 31 to the host module 30, confirming receipt of the transmitted instruction signal.

As shown in FIG. 1, host module 30 is also mounted in bidirectional conductive relationship (via UART link) with controller 12 and, incorporating its own programmable microprocessor and wireless transceiver, transmits the appropriate instruction signal to the fixture 31. As subsequently described, the nature and content of the instruction signal depends upon whether the door status command is being proximately generated (i.e., from a location in which the area surrounding the garage is in safe view of the user activating the command) or is being remotely generated out of such safe view (so as to make the impending door movement unattended.)

Referring to FIG. 1, there is now described the operation of the system 10. An absolute position encoder (APE) 15 is operatively coupled with the motor 14 and, in particular, the interconnected motor driven jackshaft. Accordingly, the encoder 15, being monitored by controller 12 via an industry standard Serial Peripheral Interface Bus (SPI Bus) 16, generates positional data output signals (designated in FIG. as "MISO" signals) corresponding to the extent and direction of rotation of the motor driven jackshaft, and therefore corresponding to the extent and direction of movement of the garage door.

The MISO positional data output signals are subsequently routed to the SPI Bus 16, the SPI Bus 16 routing the MISO data signals through input buffers 20 and 20', where the buffered positional data signals are thereafter routed to the input of an initial programmable microprocessor 21 of the integrated door control module 2.

In accordance with the process subsequently described, the MISO positional data signals are then processed by microprocessor 21, pursuant to the hereinafter described programmable-controlled operation, to produce digital door status signals indicative of the "open" or "closed" status of the garage door. This programmed-controlled operation proceeds in three sequential steps, namely (i) an initial determination, based upon multiple open/close cycles of the garage door between fully open and fully closed positions, of the location of the fully closed garage door travel limit, (ii) thereafter, after the garage door movement stops, a determination whether the halted door is within a preset distance from the fully closed position to be considered "closed" and, if not, to be considered "not closed" (i.e., "open"), and (iii) the generation of digital door status signals at the output of microprocessor 21 corresponding to either the "closed" or "open" status of the garage door.

The so-generated digital door status signals are then transmitted from microprocessor 21, by way of UART serial link, to microprocessor 22 (in the direction of the upwardly pointed arrow) for initial storage and WiFi conditioning, and thereafter transmission to Wi-Fi transceiver 23 where, in its transmission mode, the transceiver wirelessly transmits the door status information, for example via the Internet, to a designated remote location, along with an identifier unique to the iDCM.

The transceiver 23, in its receiving mode, is also effective to receive remotely generated wireless change-of-positional door status commands, each such command then routed to microprocessor 22. After the change-of-positional door status command is compared with any door status information previously stored in microprocessor 22, to assure that the requested door status made the subject of the incoming command is not already the existing status, the requested positional door status command is then routed by microprocessor 22 (now, in the direction of the downwardly pointed arrow) to microprocessor 21.

The microprocessor 21, upon receipt of such remotely generated requested positional door status command, activates the discrete light interface circuitry 24 to generate a Light/Sound Command signal pulse. This Light/Sound Command pulse is conductively routed to the host module 30 that, in response, wirelessly instructs the fixture 31 to activate the work light to begin flashing and the sounder to emit a warning sound. The flashing light and warning sound continue for a predetermined warning period of time necessary to provide sufficient advance notice of the impending unattended garage door movement. In the meantime, the acknowledge signal, which had been transmitted from the fixture 31 to the host 30 in confirmation of receipt of the instruction signal from the host 30, is conductively routed, via digital input module 26, to programmable microprocessor 21, for the purpose subsequently described.

After a predetermined time delay after the microprocessor 21 activated the Light/Sound Command, the time delay being preferably at least as long as the aforementioned flashing light and sounder advance warning time, microprocessor 21 automatically activates the door command generator 25 to generate a door command pulse that is conductively routed, via input circuitry 18, to garage door operator processor 12, thereby actuating the processor to operate the motor to move the garage door in accordance with the requested positional door status command. However, and in accordance with another unique feature of the described system 10, should the Light/Sound Acknowledge signal not be received by microprocessor 21 during the aforementioned predetermined delay period (potentially because fixture 31 had not been activated), the microprocessor is programmed to not generate the door command pulse.

Further with respect to the Bluetooth wireless communication assembly, the fixture 31 is adapted to be mounted in any convenient location in the garage and includes sockets or the like for retaining (i) a work light of desired intensity and longevity and (ii) a sounder alarm of sufficient volume.

When responding to requested door commands that have been remotely generated by a user not in full view of the garage area, or automatically generated without user participation, after the host module 30 and fixture 31 are appropriately paired, the host module 30 will generate the wireless instruction signal to actuate the fixture 31 to flash the work light and sound the alarm for the duration and rate compliant with UL 325. On the other hand, when responding to requested door commands that are locally or proximately user-generated, such as door commands user-generated from the wall console 17, after the host module 30 and the fixture 31 are appropriately paired, the host module 30 will generate a wireless instruction signal to actuate the fixture 31 to only turn on the work light in connection with the garage door movement. Thus, the microprocessor in the Bluetooth host module 30 is programmed to distinguish between the remotely generated door commands and the proximately generated door commands in order to send the appropriate instructions to the fixture 31.

Further with respect to the encoder 15, a typical absolute position encoder (APE) consists of two gear wheels directly coupled together to form a gear train. One of the two gear wheels may have 30 teeth, and the second gear wheel may have 29 teeth. This gear train will then typically be coupled to a 60 tooth gear affixed to the output shaft (the "jackshaft") of the door opener. Each of the two gear wheels of the absolute position encoder has a magnet, in a fixed orientation, permanently attached to its respective gear wheel such that each magnet rotates at the same angular rate as its respective gear wheel.

During the rotation of the jackshaft, and the consequent rotation of the two gear wheels, the angular displacement of each magnet is measured by a pair of Hall effect angle sensors. By arithmetically combining the two angle values, the position of the rotating jackshaft (and therefore the position of the garage door) can be continuously determined, with this garage door position information represented by the output signal MISO.

The Hall effect angle sensors in the APE make their measured angle data information available through the operation of the SPI Bus 16. Specifically, the SPI Bus 16 is a multidrop synchronous serial communications bus in a master/slave configuration. The controller 12 functions as the master periodically appropriately querying the pair of Hall effect angle sensors through use of incoming slave clocking signals SCLK, data signals MOSI, and dedicated enable (address) signals CS1 and CS2 respectively for each angle sensor. These same signals are routed, along with output data signal MISO, through the two input buffers 20 and 20′ to respectively minimize additional loading on the SPI Bus 16 and minimize the effects of noise pick-up over the cables routing the signals from the jackshaft opener board to the IDCM board.

Various modifications may be made to the disclosed embodiment without departing from the principles of the present invention. For example, while the disclosure references the use of microprocessors for carrying out the respective programmable functions, one may also use an alternative programmable platform for such functions, including a microcontroller, programmable logic or gate array, or the like, that can be readily programmed to perform the functions set forth herein.

Moreover, those skilled in the art, having the benefit of this disclosure, will appreciate that other embodiments can be envisioned that do not depart from the spirit and scope of the invention as defined solely by the attached claims, and equivalents thereof.

What is claimed is:

1. A garage door status monitoring and control system, comprising:

a control module for receiving garage door position information and for receiving change of garage door position commands from a remotely located Internet access device, said control module comprising a programmable platform configured to:

route said garage door position information to a wireless interface for transmission to said Internet access device, and cause said change of garage door position commands to generate a light and sound command to a Bluetooth microprocessor, as well as generate a door position command corresponding to said change of garage door position commands, the Bluetooth microprocessor controllably generating a wireless signal to actuate a light fixture with a sounder in response to receipt of the light and sound command, the light fixture incorporating a microprocessor for wirelessly returning an acknowledge signal to the Bluetooth microprocessor indicating receipt of the wireless signal to actuate the light fixture, and the acknowledge signal conductively transmitted to the programmable platform from the Bluetooth microprocessor, wherein the receipt of the acknowledge signal allows the door position command to be generated by the programmable platform only after a defined period of time following the generation of the light and sound command, and wherein absence of receipt of the acknowledge signal during the defined period of time prevents the generation of the door position command.

2. A garage door positional status monitoring and control system, comprising:

garage door opener apparatus comprising a jackshaft motor drive assembly including a horizontally positioned jackshaft, a motor for rotating the jackshaft, and a programmable door operator controller for processing both remotely generated positional door status commands and proximately generated positional door status commands and generating output signals controlling operation of the motor to move a garage door to positions corresponding to the remotely generated positional door status commands and the proximately generated positional door status commands;

an absolute position encoder operatively coupled with the jackshaft motor drive assembly and configured to generate positional data signals corresponding to an extent and a direction of rotation of the jackshaft;

a first programmable platform apparatus separate from the programmable door operator controller and configured to process the positional data signals pursuant to programmable-controlled operation configured to produce a digital door status signal indicative of either an open status or a closed status of the garage door, the programmable-controlled operation comprising three sequential steps comprising:

(i) determine, based upon multiple open/close cycles of the garage door, a location of a fully closed garage door travel limit, (ii) determine, after movement of the garage door has stopped, whether the garage door is within a preset distance from the fully closed garage door travel limit, and (iii) generate the digital door status signal based upon determining whether the door is within the preset distance from the fully closed garage door travel limit;

a transceiver operatively coupled to the first programmable platform apparatus and configured to:

when in a transmission mode, wirelessly transmit door status information corresponding to the digital door status signal, and when in a receive mode, receive a remotely generated change-of-positional door status command;

a fixture retaining a work light and a sounder; and a second programmable platform apparatus separate from the programmable door operator controller and configured to:

cause transmission of a light/sound command to actuate the work light and sounder for a predetermined period of time, receive an acknowledge signal transmitted in confirmation of receipt of said light/sound command, and cause transmission of a door command pulse to actuate the programmable door operator controller to move the garage door in accordance with the change-of-positional door status command, wherein the transmission of the door command pulse is delayed for a period of time after the transmission of the light/sound command.

3. The garage door positional status monitoring and control system of claim 2, wherein the first programmable platform apparatus and the second programmable platform apparatus are the same.

4. The garage door positional status monitoring and control system of claim 3, wherein the first and second programmable platform apparatus comprises a microprocessor.

5. The garage door positional status monitoring and control system of claim 2, wherein the period of time for which the transmission of the door command pulse is delayed is at least as long as the predetermined period of time.

6. The garage door positional status monitoring and control system of claim 3, wherein failure of the acknowledge signal to reach the first and second programmable platform apparatus prevents transmission of the door command pulse.

7. A garage door positional status monitoring and control system, comprising:

a garage door opener apparatus comprising a jackshaft motor drive assembly including a horizontally positioned jackshaft, a motor for rotating the jackshaft, and a programmable door operator controller for processing both remotely generated and proximately generated positional door status commands and generating output signals controlling operation of the motor to move a garage door to positions corresponding to the remotely generated positional door status commands and the proximately generated positional door status commands;

an absolute position encoder operatively coupled with the jackshaft motor drive assembly and configured to generate positional data signals corresponding to an extent and a direction of rotation of the jackshaft;

a programmable microprocessor configured to process the positional data signals to produce a digital door status signal indicative of either an open status or a closed status of the garage door, by:

(i) determining, based upon multiple open/close cycles of the garage door, a location of a fully closed garage door travel limit, (ii) determining, after movement of the garage door has stopped, whether the garage door is within a preset distance from the fully closed garage door travel limit, and (iii) generating the digital door status signal based upon the determining whether the garage door is within the preset distance from the fully closed garage door travel limit;

a transceiver operatively coupled to the microprocessor and configured to:

when in a transmission mode, wirelessly transmit door status information corresponding to the digital door status signal, and when in a receive mode, receive a remotely generated change-of-positional door status command, and route the change-of-positional door status command to the microprocessor; and a short range wireless communication assembly comprising a host module and a fixture retaining an actuable work light;

wherein the microprocessor is configured to, upon receipt of the change-of-positional door status command, cause transmission of a command to the host module to cause the host module to wirelessly transmit instructions to the fixture to flash the work light for a predetermined period of time, the fixture being configured to wirelessly transmit an acknowledge signal to the host module when the host module successfully transmits the instructions to the fixture and the host module is configured to route the acknowledge signal to the microprocessor, the microprocessor being configured to cause transmission of a door command pulse to actuate the door operator controller to move the garage door in accordance with the change-of-positional door status command, wherein the microprocessor is configured to delay the transmission of the door command pulse for a period of time after the transmission of the command to the host module at least as long as the predetermined period of time, and wherein microprocessor is configured to prevent the transmission of the door command pulse in the absence of receipt of the acknowledge signal.

8. The garage door positional status monitoring and control system of claim 7, wherein the host module is in bidirectional communication with the door operator controller, and wherein the host module is configured to transmit an instruction to the fixture to turn on the work light in response to receipt of a proximately generated positional door status command routed to the door operator controller.

* * * * *